US005179074A

United States Patent [19]

Fiedziuszko et al.

[11] Patent Number: 5,179,074

[45] Date of Patent: Jan. 12, 1993

[54] HYBRID DIELECTRIC RESONATOR/HIGH TEMPERATURE SUPERCONDUCTOR FILTER

[75] Inventors: Slawomir J. Fiedziuszko, Palo Alto; Stephen C. Holme, San Ramon, both of Calif.

[73] Assignee: Space Systems/Loral, Inc., Palo Alto, Calif.

[21] Appl. No.: 645,911

[22] Filed: Jan. 24, 1991

[51] Int. Cl.[5] ..... H01P 7/10; H01P 1/201; H01B 12/06

[52] U.S. Cl. ..... 505/1; 505/700; 505/866; 333/99 S; 333/202; 333/219.1

[58] Field of Search ..... 333/99 S, 202, 227, 333/219.1; 505/1, 700, 701, 866

[56] References Cited

U.S.-PATENT DOCUMENTS

| | | | |
|---|---|---|---|
| 4,423,397 | 12/1983 | Nishikawa et al. | 333/219.1 |
| 4,453,146 | 6/1984 | Fiedziuszko | 333/212 |
| 4,489,293 | 12/1984 | Fiedziuszko | 333/202 |
| 4,692,723 | 9/1987 | Fiedziuszko et al. | 333/202 |
| 4,821,006 | 4/1989 | Ishikawa et al. | 333/219.1 X |
| 4,918,049 | 4/1990 | Cohn et al. | 505/1 |
| 4,918,050 | 4/1990 | Dworsky | 505/1 |

FOREIGN PATENT DOCUMENTS

| | | | |
|---|---|---|---|
| 14202 | 1/1982 | Japan | 333/219.1 |
| 1-20902 | 5/1989 | Japan | 505/1 |
| 1-54603 | 6/1989 | Japan | 333/219.1 |

OTHER PUBLICATIONS

Carr, "Potential Microwave Applications of High Temperature Superconductors", *Microwave Journal*, Dec. 1987, pp. 91–94.

Braginski et al. "Prospects for Thin-film Electronic Devices Using High-$T_c$ Superconductors", *5th International Workshop on Future Electron Devices*, Jun. 2–4, 1988, Miyagi-Zao, pp. 171–179.

Zahopolis et al., "Performance of a Fully Superconductive Microwave Cavity Made of the High $T_c$ Superconductor $Y_1Ba_2Cu_3O_y$", *Applied Physics Letters*, vol. 52(25), Jun. 20, 1988, pp. 2168–2170.

*Primary Examiner*—Eugene R. LaRoche
*Assistant Examiner*—Benny T. Lee
*Attorney, Agent, or Firm*—Townsend and Townsend

[57] ABSTRACT

A waveguide cavity filter having a conductive housing, a plurality of high dielectric constant ceramic resonators disposed within the conductive housing and at least a portion of a sheet of superconductive material which is constrained to be at an ambient temperature below the critical temperature of the superconductor and disposed in contact with at least one of the side walls of the conductive housing and with an opposing surface of each of the resonators, such that the resonators are in close superconductive contact with the side walls of the conductive housing. In particularly, the superconductive sheet is a layer of high temperature superconductor. In a first embodiment of the invention, the resonators in the shape of cylindrical plugs are disposed with a flat surface juxtaposed to the side wall. In a second embodiment, the resonators are in the form of half cylindrical plugs with the axis of the half cylinder transverse to the axis of the resonator, in contact with the superconductor sheet and in juxtaposition to the side wall. In a further embodiment of the invention, the resonators are quarter circular cylindrical plugs and each of the flat side surfaces is in contact with a juxtaposed side wall of the conductive housing through a sheet of superconductive material.

9 Claims, 3 Drawing Sheets

HYBRID DIELECTRIC RESONATOR/HIGH TEMPERATURE SUPERCONDUCTOR FILTER

SPONSORSHIP

This invention was made under contract with and supported by The United States Naval Research Laboratory, under contract No. N00014-89-C-2248. Rights in this invention have been retained by the contractor.

BACKGROUND OF THE INVENTION

This invention relates to the field of filtering electromagnetic energy in the microwave region in connection with a high temperature superconductor in certain configurations of microwave frequency resonator-filter combinations. Superconductive materials and particularly the recently developed high temperature superconductor (HTS) offer potential advantages when used in connection with microwave components such as filters and multiplexers. Among the primary advantage is a potential for substantial decrease in insertion loss. In specific applications, such as satellite payload applications, the potential for improvement must be weighed against the disadvantage of increasingly-complicated thermal design to provide the required cooling. What is needed is a new type of microwave filter design which can provide significant reductions in size and weight sufficient to justify the added complication of cooling.

The following references have been noted as a potentially relevant to the subject invention:

Carr, "Potential Microwave Applications of High Temperature Superconductors", *Microwave Journal*, December 1987, pp. 91–94. This paper discusses some of the advantages of using superconductors and microwave structures. One of the advantages is lower loss. Notwithstanding, there is nothing that suggests the structure of the present invention.

Braginski et al. "Prospects for Thin-film Electronic Devices Using High-$T_c$ Superconductors", *5th International Workshop on Future Electron Devices*, Jun. 2–4, 1988, MiyagiZao, pp. 171–179. This paper discusses HTS technologies with representative device high frequency transmission strip lines, resonators and inductors. It also highlights in general terms alternative processes for the film fabrication. It doesn't address the structures themselves and how they might be employed in a specific resonator structure.

Zahopoulos et .la , "Performance of a Fully Superconductive Microwave Cavity Made of the High $T_c$ Superconductor $Y_1Ba_2Cu_3O_y$", *Applied Physics Letters*, Vol. 52(25), 20 Jun. 1988, pp. 2168–2170. This paper describes a cavity fabricated with high temperature superconductive materials. The resonator employs a medium dielectric constant resonator which substantially fills a conductive cavity in a experimental structure. There is no way to tune the resonator because it is a fully enclosed structure, so it is not functional as a resonator. There are no teachings as to how to use a dielectric resonator within a cavity where the cavity itself is not fully superconductive.

U.S. Pat. Nos. 4,453,146, 4,489,293 and 4,692,723 are representative of work done on behalf of the predecessor to the assignee of the present invention. They describe various narrow band dielectric resonator/filters. There is no suggestion whatsoever in these patents of how to make effective use of superconductive materials as a wall or a portion of wall cavity.

Dworsky, U.S. Pat. No. 4,918,050 issued Apr. 17, 1990. This patent describes a reduced size superconductive resonator including high temperature superconductors. This patent describes a TEM mode resonator in which the cavity is constructed of superconductive material wherein a finger of the superconductive material extends within the wall of the cavity, and in which the cavity itself is filled with a high dielectric constant material. Since this is a TEM or quasi-TEM mode resonator, its structure cannot be readily compared to a TE mode structure.

Cohn et al., U.S. Pat. No. 4,918,049 issued Apr. 17, 1990. This patent discloses a microwave/far infrared cavity and waveguide using high temperature superconductors. Therein, a cylindrical cavity with an input and an output is provided with an inner wall composed of superconductive material. In one strip line structure, a low-loss dielectric is enclosed within a cavity with a superconductive wall and a superconductive strip mounted on a low-loss dielectric material overlying a superconducting ground plane or a conventional ground plane. The structure is substantially different than anything disclosed in the present application.

In addition to the foregoing, it is believed that a number of research groups are developing waveguide cavities in which HTS materials line the waveguide cavities or the waveguide cavities are constructed entirely of HTS. While considerable reduction in size is possible with this technology, the size of filters constructed in accordance with such a method is excessively large. Moreover, current technology does not allow the deposition as HTS thin films on any suitable cavity material. As a result, current cavities are typically made for bulk material which is typically only somewhat better than copper at best. Therefore, applications are expected to be limited to those areas where loses are very costly and small size is not desirable in the operating environment.

It has been known to make use of high-dielectric constant ceramics as resonators within waveguide cavities to allow size reduction of the resonator cavities. Placement of dielectric resonators within a waveguide cavity has in the past required that the resonator be supported at or near the center of the cavity or at least between the side walls of the cavity, which militates against substantial size reduction of the cavity. It is worthwhile to explore structures which would allow still further size reduction.

SUMMARY OF THE INVENTION

According to the invention, there is provided a waveguide cavity filter having a conductive housing, a plurality of high dielectric constant ceramic resonators disposed within the conductive housing and at least a portion of a sheet of superconductive material which is constrained to be at an ambient temperature below the critical temperature of the superconductor and disposed in contact with at least one of the side walls of the conductive housing and with an opposing surface of each of the resonators, such that the resonators are in close superconductive contact with the side walls of the conductive housing. In particularly, the superconductive sheet is a layer of high temperature superconductor. In a first embodiment of the invention, the resonators in the shape of cylindrical plugs are disposed with a flat surface juxtaposed to the side wall. In a second embodiment, the resonators are in the form of half cylindrical plugs with the axis of the half cylinder transverse to the axis of the resonator, in contact with the superconductor sheet and in juxtaposition to the side wall. In a further embodiment of the invention, the resonators are quarter circular cylindrical plugs and each of the flat side surfaces is in contact with a juxtaposed side wall of the conductive housing through a sheet of superconductive material.

The invention will be better understood by reference to following detail description in connection with the accompanying drawings.

DESCRIPTION OF SPECIFIC EMBODIMENTS

Figure 1:
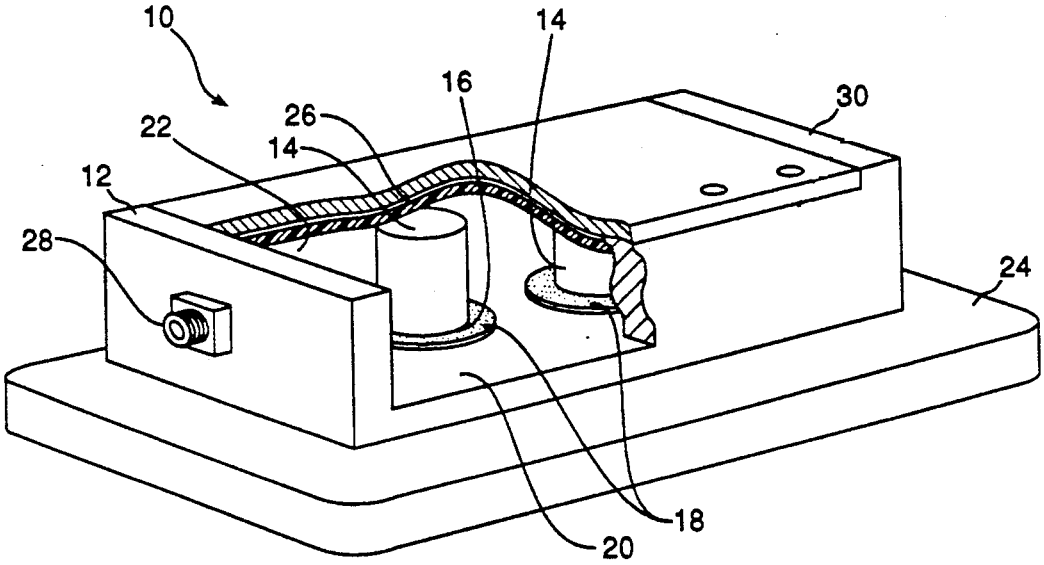
FIG. 1 is a prospective view in partial cutaway of a hybrid resonator/filter in accordance with the invention.

Referring to FIG. 1, there is shown a hybrid dielectric resonator/filter 10 according to one embodiment showing specific elements which are common to all embodiments described hereinafter. The filter 10 includes a rectangular cross-section conductive housing 12 and a plurality of high dielectric constant ceramic resonators 14 disposed within the housing which, in this embodiment, are right circular cylinders, or simply plugs 14. The ceramic plugs 14 are, according to the invention, mounted within the housing 12 with at least one surface 16 abutting a relatively thin layer 18 of superconducting material which in turn abuts an inner surface 20 of a conductive wall of the conductive housing 12. The layer 18 need not cover the entire wall surface 20. It may be as small as the surface area of surface 16.

A particular advantage of the invention is that the superconductive material minimizes losses within the cavity 22 formed by the housing 12 and allows construction of a hybrid resonator/filter of compact size relative to other structures of comparable performance characteristics. Whereas it would be necessary to space the resonator 14 from the conductive wall 20, the interposition of a superconductive layer 18 allows the resonator 14 to be juxtaposed to the wall 20, thereby reducing cavity height requirements.

The resonator 14 is preferably constructed a high performance ceramic such as zirconium stannate ($ZrSnTiO_4$) or advanced perovskite added material ($BaNiTiO_3BaZrSnTiO_3$). Zirconium stannate provides acceptable performance above about 6 GHz and very good results at frequencies below 2 GHz. Perovskite added material is more suited for higher frequencies and is excellent above 4 GHz, although it is about 50% heavier.

The superconductive layer 18 is preferably constructed of the new class of high temperature superconductors, such as the ceramic yttrium-barium copper oxide, which is capable of superconducting at temperatures as high as about 77°K thus making it possible to be cooled by liquid nitrogen rather than more expensive and less readily available coolants such as liquid helium. The filter 10 according to the invention may therefore be provided with any suitable heat exchanger 24 for the coolant whereby the structure is cooled. The heat exchanger 24, which may well be part of an enclosing envelope, is used to maintain the housing 12 at or below the critical temperature ($T_c$) of the superconductor. The design of the heat exchanger 24 is a function of the environment. For example, in the context of a spacecraft, a premium is placed on size and weight, while cost is a secondary consideration.

The resonator 14 is preferably held in place mechanically by a spacer sheet or web 26. While it may be possible to provide an adhesive between the resonator 14 and the layer 18 at the abutting surface 16, it is preferred that the contact be made as free of contaminating materials as is possible.

As is conventional for a filter, there is an input port 28 and an output port 30 for coupling microwave energy through the structure. Other conventional elements, such as coupling probes 32 and 34 (FIG. 2) are also included.

Figure 2:
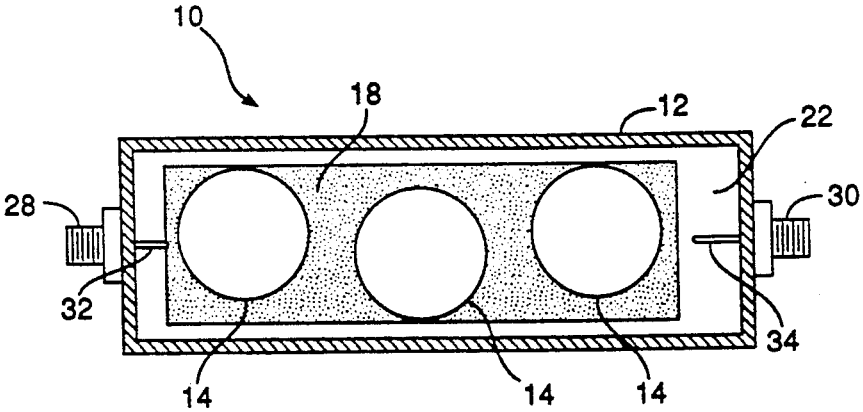
FIG. 2 is a top cross-sectional view of hybrid resonator/filter in accordance with the invention.

FIGS. 2 through 9 illustrate specific embodiments. Similar elements are referenced by identical enumeration. In FIG. 2, right circular cylindrical plugs mounted in a preselected pattern in the housing 12 form the resonators 14. They are disposed on the layer 18 of superconductive material substantially covering one wall of the housing 12. The input port 28 and output port 30 are provided with probes 32 and 34 which are impedance matched for coupling into the cavity 22. The placement and size of the resonators 14 are selected in accordance with generally understood design principles. A suitable reference for the design principles for the resonant modes in a shielded dielectric rod resonator is the paper by Kobayashi et al. entitled "Resonant Modes for a Shielded Dielectric Rod Resonator", *Electronics and Communications in Japan,* Vol. 64-B, No. 11, 1981, pps. 44–51 (ISSN 0424-8368/81/0011/0044$7.50/0). This paper is incorporated herein by reference. The designs herein are principally in support of the $TE_{01X}$ modes of a rectangular resonant cavity, where X=0,1,2,3, etc. Where the cavity is provided with an additional superconductive structure therein, insertion loss is decreased, conductivity is enhanced, and the size can be reduced relative to a comparable filter which does not benefit from the extremely low loss characteristics of a superconductor.

Figure 3:
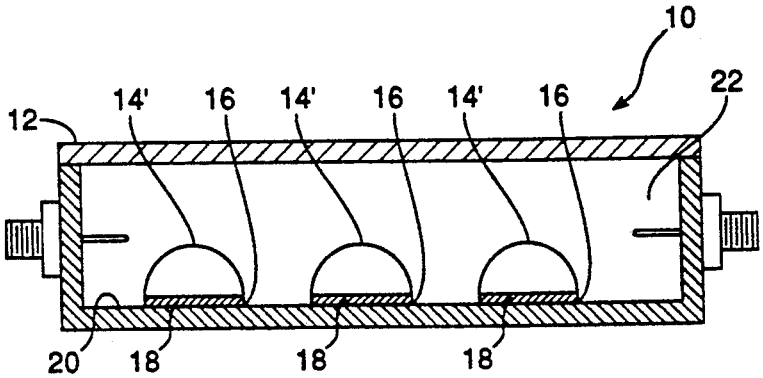
FIG. 3 is a side cross-sectional view of an alternative embodiment of a hybrid resonator/filter in accordance with the invention.

Referring to FIG. 3, there is shown an embodiment wherein resonators 14' are formed of half circular cylinders having the principal axis transverse to the axis of the rectangular resonator cavity 22. Superconductive layers 18 are disposed as pads between the faces 16 of the resonators 14' and the inner wall 20 of the housing 12.

Figure 4:
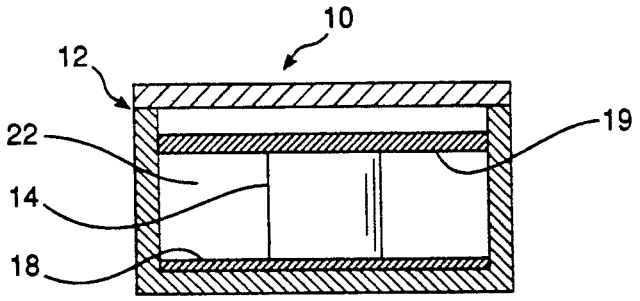
FIG. 4 is an end cross-sectional view of one embodiment of the invention.
Figure 5:
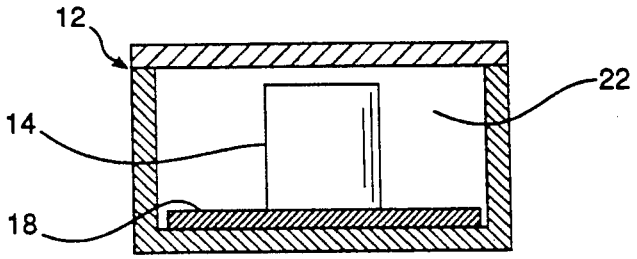
FIG. 5 is an end cross-sectional view of a further embodiment of the invention.
Figure 6:
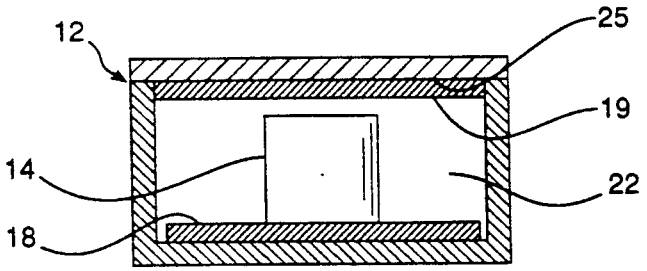
FIG. 6 is an end cross-sectional view of a still further embodiment of the invention.

Referring to FIG. 4, there is shown an end cross-sectional view of a filter 10, corresponding to either FIG. 1 or FIG. 2, wherein a first superconductive layer 18 underlies a resonator 14 and a second superconductive layer 19 is a sheet which overlays the resonator 14 and is in contact therewith. The layer 19 may extend the width and potentially the length of the cavity 22 to promote superconductive coupling to the cavity walls. In the alternative, a single layer 18 on one wall of the cavity 22 may be in contact with a right circular cylindrical plug 14 (FIG. 5). As a further alternative, layer 18 may be in contact with the right circular cylindrical plug 14 and second layer 19 may be spaced from the plug 14 and in contact with opposing wall 25 of the cavity 22 (FIG. 6).

Figure 7:
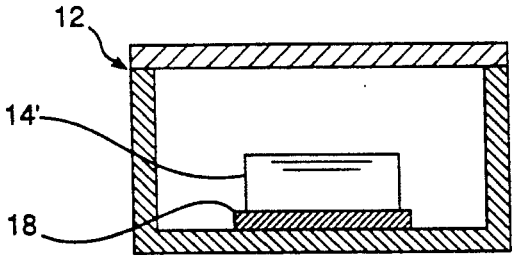
FIG. 7 is an end cross-sectional view of the embodiment of FIG. 3.

In FIG. 7, a half cylinder resonator 14' as in FIG. 3 is in contact with a superconductive layer 18. The half cut dielectric resonator filter as shown in FIG. 3 and FIG. 7 has the advantage of allowing that only one face be in contact with HTS material, thereby reducing size and cost at the expense of somewhat reduced Q factor.

Figure 8:
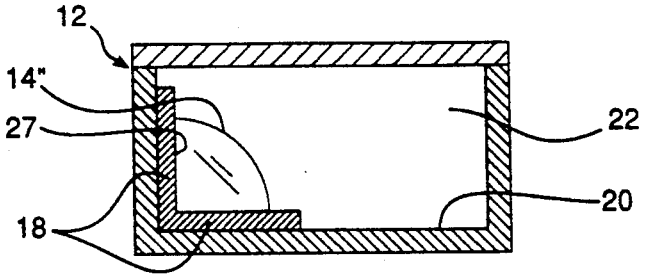
FIG. 8 is an end cross sectional view of a still further embodiment of the invention.

In FIG. 8, a configuration is illustrated wherein a quarter cylinder resonator 14'' is disposed against superconductive layers 18 abutting two adjacent surfaces of the cavity 22, namely, a sidewall 27 and base wall 20. The quarter-cut dielectric resonator/filter in FIG. 8 offers the additional advantage of even smaller volume but at somewhat further reduced Q factor. A specific advantage of a quarter-cut design is the effective elimination of spurious HE modes of oscillation.

Figure 9:
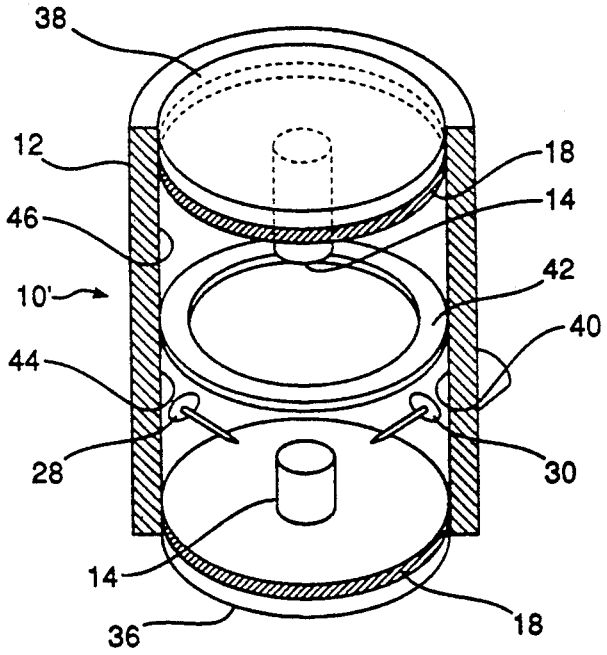
FIG. 9 is a prospective view in partial cutaway of a still further embodiment of the invention.

Referring to FIG. 9, there is shown a hybrid resonator/filter 10' suitable to support a different resonant mode, namely, the $TE_{11}$ mode of oscillation. Plug-type resonators 14 are mounted on opposing end walls 36, 38 of a right circular cylindrical cavity 40, and each of the resonators 14 is mounted on a superconductive layer 18 against the adjacent end wall 36, 38. A coupling aperture 42 is provided for coupling between first and second cavity segments 44, 46. Input and output ports 28 and 30 are provided. This cavity design is similar to the type disclosed in U.S. Pat. No. 4,540,955 issued Sept. 10, 1985 to one of the coinventors herein. The filter design in FIG. 9 is an HTS/dielectric resonator hybrid design which resonates at the $HE_{111}$ mode with two orthogonal modes per cavity.

It is significant to note that high-temperature superconductor layers 18 are required only directly between the resonators 14 and the cavity walls 36, 38. Additional features are the exceptionally high Q factor, due in large part to the high temperature superconductors and low dielectric loss in the resonators at low temperature. The size of the resonators may be smaller when operating in a known cool ambient environment due to the effective increase in the dielectric constant of the ceramics. Operating the filter with resonators at reduced temperature improves efficiency of the resonators. Further, because a cooling system is needed which typically requires temperature regulation to maintain superconductivity, a filter according to the invention benefits from excellent temperature stability. The device is designed so that it can be tuneable.

The invention has now been explained with reference to specific embodiments. Other embodiments will be apparent to those ordinarily skilled in the art. It is therefore not intended that this invention be limited except as indicated by the appended claims.

What is claimed is:

1. A waveguide cavity having a conductive housing with a first interior wall, and an axis parallel to the first interior wall, and at least one high dielectric constant ceramic resonator element with at least one flat surface disposed within the conductive housing, further comprising:

a temperature control means in thermal communication with the conductive housing;

at least a first superconductive sheet of superconductive material, said first superconductive sheet being maintained at an ambient temperature below the critical temperature for superconduction by said temperature control means, said first sheet being disposed in contact with the first interior wall of the conductive housing and with said at least one flat surface of the at least one resonator element, said first superconductive sheet being sufficient to cover said at least one flat surface, such that the at least one resonator element is in superconductive contact with the first interior wall.

2. The waveguide cavity according to claim 1, wherein said superconductive material is a high temperature superconductor.

3. The waveguide cavity according to claim 1, wherein the waveguide cavity further comprises a plurality of flat side walls contacting the first interior wall, said plurality of flat side walls configured to provide a rectangular cross section, said cross section coincident with the first interior wall, wherein the at least one resonator element is in the shape of a right circular cylindrical plug, and wherein the at least one resonator element is disposed with said at least one flat surface abutting said first superconductive sheet and juxtaposed to the first interior wall.

4. The waveguide cavity according to claim 1, wherein the waveguide cavity further comprises a plurality of flat side walls contacting the first interior wall, said plurality of flat side walls configured to provide a rectangular cross section, said cross section coincident with the first interior wall, wherein the at least one resonator element is in the shape of a half-cut circular cylindrical plug, said at least one flat surface being in the shape of a rectangle, and wherein the at least one resonator element is disposed with a cylindrical axis of the at least one resonator element transverse to the axis of the waveguide cavity and said at least one flat surface abutting said first superconductive sheet and juxtaposed to the first interior wall.

5. The waveguide cavity according to claim 1, wherein the waveguide cavity further comprises a plurality of flat side walls contacting the first interior wall, said plurality of flat side walls configured to provide a rectangular cross section, said cross section coincident with the first interior wall, wherein the at least one resonator element is in the shape of a quarter-cut circular cylindrical plug, said at least one flat surface being in the shape of a rectangle, the at least one resonator element also having a second rectangular face perpendicular to said flat surface, and wherein the at least one resonator element is disposed with an axis parallel to the axis of the waveguide cavity and wherein said second rectangular face abuts said first superconductive sheet, said first superconductive sheet being further sufficient to cover said at least one flat surface and said second rectangular face and wherein said second rectangular face is juxtaposed to one of said flat side walls.

6. The waveguide cavity according to claim 1, further including a second superconductive sheet extending across the waveguide cavity, wherein the waveguide cavity further comprises a plurality of flat side walls contacting the first interior wall, said plurality of flat side walls configured to provide a rectangular cross section, said cross section coincident with the first interior wall, wherein the at least one resonator element is in the shape of a right circular cylindrical plug, and wherein the at least one resonator element disposed with a second flat surface abutting said second superconductive sheet.

7. The waveguide cavity according to claim 1, further including a second superconductive sheet extending across the waveguide cavity and parallel to the first interior wall, wherein the waveguide cavity further comprises a plurality of flat side walls contacting the first interior wall, said plurality of flat side walls configured to provide a rectangular cross section, said cross section coincident with the first interior wall, wherein the at least one resonator element is in the shape of a right circular cylindrical plug, wherein said second superconductive sheet is juxtaposed to a second interior wall, said second interior wall configured to be parallel to said first interior wall.

8. A waveguide cavity having a cylindrical conductive housing with flat interior end walls and a first high dielectric constant ceramic resonator element with at least one flat surface disposed within the conductive housing, further comprising:

a temperature control means in thermal communication with the conductive housing;

a first superconductive sheet of superconductive material, said first superconductive sheet being maintained at an ambient temperature below the critical temperature for superconduction by said temperature control means, said first sheet being disposed in contact with a first one of said interior end walls of the conductive housing and in contact with said at least one flat surface of the first resonator element, the superconductive sheet being sufficient to cover said at least one flat surface, such that the first resonator element is in superconductive contact with the first interior end wall.

9. The waveguide cavity according to claim 8, further comprising:

a cylindrical wall disposed between the interior end walls;

an aperture means for creating an aperture, said aperture means supported by the cylindrical wall;

a coupling aperture bounded by said aperture means, said coupling aperture separating said housing into a first half cavity and a second half cavity, wherein said first resonator is in the first half cavity; and a second superconductive sheet of superconductive material, said second superconductive sheet being maintained at an ambient temperature below the critical temperature for superconduction by said temperature control means, said second sheet being disposed in contact with a second one of said interior end walls of the conductive housing and with a flat surface of a second resonator element with at least one flat surface in said second half cavity, said second superconductive sheet being sufficient to cover said flat surface of said second resonator element, such that said second resonator element is in superconductive contact with said second interior end wall.

* * * * *